US012089699B2

(12) United States Patent
Weidl et al.

(10) Patent No.: US 12,089,699 B2
(45) Date of Patent: Sep. 17, 2024

(54) BASEPLATE FOR A SHOE

(71) Applicant: adidas AG, Herzogenaurach (DE)

(72) Inventors: Jürgen Weidl, Herzogenaurach (DE); Antonio Jamie Zea, Jr., Baltimore, MD (US); Wilfried Ernst Wiederer, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 381 days.

(21) Appl. No.: 17/468,781

(22) Filed: Sep. 8, 2021

(65) Prior Publication Data

US 2021/0401123 A1 Dec. 30, 2021

Related U.S. Application Data

(62) Division of application No. 14/976,851, filed on Dec. 21, 2015, now Pat. No. 11,134,752.

(30) Foreign Application Priority Data

Jan. 15, 2015 (DE) ..... 102015200526.7

(51) Int. Cl.
*A43C 15/02* (2006.01)
*A43B 3/24* (2006.01)
(Continued)

(52) U.S. Cl.
CPC ..... *A43C 15/02* (2013.01); *A43B 3/246* (2013.01); *A43B 5/02* (2013.01); *A43B 13/184* (2013.01);
(Continued)

(58) Field of Classification Search
CPC ..... A43B 3/244; A43B 3/246; A43B 5/02; A43B 13/184; A43B 13/223; A43B 13/26;
(Continued)

(56) References Cited

U.S. PATENT DOCUMENTS 997,657 A 7/1911 Drake
2,332,000 A 10/1943 Murray
(Continued)

FOREIGN PATENT DOCUMENTS

CN 2485993 4/2002
CN 102164518 8/2011
(Continued)

OTHER PUBLICATIONS

U.S. Appl. No. 14/976,851, Final Office Action mailed Jan. 30, 2018, 17 pages.
(Continued)

*Primary Examiner* — Jameson D Collier
(74) *Attorney, Agent, or Firm* — Kilpatrick Townsend & Stockton LLP

(57) ABSTRACT

Baseplates for shoes, wherein the baseplate is removably insertable into a shoe upper, and wherein the baseplate includes a substantially planar body, which is configured to provide stability to the shoe upper, and a plurality of tread elements, which are configured to protrude through a respective opening of a plurality of openings in a bottom portion of the shoe upper when the baseplate is removably inserted into the shoe upper, wherein the plurality of tread elements are unitarily formed with the body.

19 Claims, 11 Drawing Sheets

(51) Int. Cl.

| | |
|---|---|
| ***A43B 5/02*** | (2006.01) |
| ***A43B 13/18*** | (2006.01) |
| ***A43B 13/22*** | (2006.01) |
| ***A43B 13/26*** | (2006.01) |
| ***A43B 13/30*** | (2006.01) |
| ***A43C 15/16*** | (2006.01) |

(52) U.S. Cl.
CPC ..... *A43B 13/223* (2013.01); *A43B 13/26* (2013.01); *A43B 13/30* (2013.01); *A43C 15/162* (2013.01)

(58) Field of Classification Search
CPC ..... A43B 13/30; A43C 15/02; A43C 15/16; A43C 15/161; A43C 15/162; A43C 15/167
USPC ..... 36/15, 59 A, 61, 62, 67 D, 107, 134; D2/906, 962
See application file for complete search history.

(56) References Cited

U.S. PATENT DOCUMENTS

| | | | | |
|---|---|---|---|---|
| 3,406,232 | A * | 10/1968 | Barker | B29D 12/02 425/808 |
| 4,372,058 | A | 2/1983 | Stubblefield | |
| 4,741,114 | A | 5/1988 | Stubblefield | |
| 5,367,791 | A | 11/1994 | Gross et al. | |
| 5,526,589 | A | 6/1996 | Jordan | |
| 5,598,644 | A * | 2/1997 | Polegato | A43B 7/125 36/59 A |
| 6,018,893 | A | 2/2000 | Workman | |
| 6,023,859 | A | 2/2000 | Burke et al. | |
| 7,249,428 | B1 | 7/2007 | Burella | |
| 7,370,439 | B1 * | 5/2008 | Myers | A43B 13/26 36/31 |
| 7,406,781 | B2 | 8/2008 | Scholz | |
| 7,451,557 | B2 | 11/2008 | Mcdonald et al. | |
| 7,730,636 | B2 | 6/2010 | Auger et al. | |
| 7,730,637 | B2 | 6/2010 | Scholz | |
| 7,793,428 | B2 | 9/2010 | Shenone | |
| D635,338 | S * | 4/2011 | Favreau | D2/962 |
| 8,474,155 | B2 * | 7/2013 | McDonald | A43B 13/223 36/102 |
| 8,813,387 | B2 | 8/2014 | Grove et al. | |
| 9,210,967 | B2 * | 12/2015 | Gerber | A43B 13/12 |
| 9,486,036 | B1 | 11/2016 | Douglas | |
| 9,737,109 | B2 | 8/2017 | Johnson | |
| 2002/0178620 | A1 | 12/2002 | Asciolla | |
| 2004/0148803 | A1 | 8/2004 | Grove et al. | |
| 2005/0268487 | A1 | 12/2005 | Ellis, III | |
| 2007/0209230 | A1 | 9/2007 | Dillon et al. | |
| 2008/0216360 | A1 | 9/2008 | Schenone | |
| 2009/0183392 | A1 | 7/2009 | Shane | |
| 2009/0320326 | A1 | 12/2009 | Keppler et al. | |
| 2010/0325917 | A1 | 12/2010 | Cass et al. | |
| 2011/0005101 | A1 | 1/2011 | Sills | |
| 2012/0210608 | A1 | 8/2012 | Baker et al. | |
| 2013/0047469 | A1 | 2/2013 | Locke et al. | |
| 2014/0150297 | A1 | 6/2014 | Holmes et al. | |
| 2014/0305007 | A1 | 10/2014 | Skaggs et al. | |
| 2015/0113831 | A1 | 4/2015 | Weingart et al. | |

FOREIGN PATENT DOCUMENTS

| | | |
|---|---|---|
| CN | 102665467 | 9/2012 |
| DE | 602004007262 | 5/2008 |
| EP | 1250860 | 10/2002 |
| EP | 1574143 | 9/2005 |
| EP | 1832190 | 9/2007 |
| FR | 2813766 | 3/2002 |
| JP | S56150401 | 11/1981 |
| JP | 3192899 | 7/2001 |
| WO | 9746127 | 12/1997 |
| WO | 2005092136 | 10/2005 |

OTHER PUBLICATIONS

U.S. Appl. No. 14/976,851, Final Office Action mailed Apr. 22, 2019, 26 pages.
U.S. Appl. No. 14/976,851, Final Office Action mailed Jan. 11, 2021, 26 pages.
U.S. Appl. No. 14/976,851, Non-Final Office Action mailed Oct. 16, 2018, 18 pages.
U.S. Appl. No. 14/976,851, Non-Final Office Action mailed Sep. 20, 2017, 18 pages.
U.S. Appl. No. 14/976,851, Non-Final Office Action mailed Mar. 24, 2020, 27 pages.
U.S. Appl. No. 14/976,851, Notice of Allowance mailed Jun. 8, 2021, 12 pages.
Chinese Patent Application No. 201610007102.5, Office Action mailed Mar. 30, 2018, 16 pages (English machine translation submitted).
Chinese Patent Application No. 201610007102.5, Office Action mailed May 17, 2017, 16 pages (English machine translation submitted-).
German Patent Application No. 102015200526.7, First Office Actio mailed Oct. 21, 2015, 7 pages. Note: A Summary of the Office Action was provided in the IDS Transmittal filed Apr. 8, 2016 in U.S. Appl. No. 14/976,851.
European Patent Application No. 15201546.7, Extended European Search Report mailed Jun. 8, 2016, 7 pages.
European Patent Application No. 15201546.7, Office Action, Mailed on Jul. 26, 2018, 4 pages.
European Patent Application No. 15201546.7, Office Action, Mailed on May 23, 2019, 6 pages.
Japanese Patent Application No. 2015-248323, Office Action mailed Jul. 30, 2019, 4 pages (English machine translation provided).
Japanese Patent Application No. 2015-248323, Office Action mailed Dec. 18, 2018, 6 pages (English machine translation provided).

* cited by examiner

BASEPLATE FOR A SHOE

CROSS REFERENCE TO RELATED APPLICATION

This application is a divisional of U.S. patent application Ser. No. 14/976,851, filed Dec. 21, 2015, entitled "Baseplate for a Shoe" (Allowed) ("the '851 application"), which is related to and claims priority benefits from German Patent Application No. 102015200526.7, filed Jan. 15, 2015, entitled "Baseplate for a Shoe" ("the '526 application"). The '851 and '526 applications are hereby incorporated herein in their entirety by this reference.

FIELD OF THE INVENTION

The present invention relates to a baseplate for a shoe, in particular a sports shoe, a shoe upper, which is suitable for the reception of the baseplate, a shoe, comprising the baseplate and the shoe upper, and a manufacturing method for each of the above.

BACKGROUND

Shoes, in particular sports shoes generally comprise a shoe upper and a sole attached thereto. The sole supports a foot of a wearer of the shoe, transmits forces from the foot to the ground and provides—depending on the intended use of the shoe—a certain amount of damping. Generally, the sole comprises a tread on its outer side, to increase the friction with the ground and to prevent an unwanted slipping of the shoe. The latter aspect is particularly relevant for sports shoes.

Sports shoes thus often comprise special treads which are adapted to the respective sport. For example, football and rugby boots often comprise studs which engage in the comparable soft ground (e.g. grass) and hence enable a large degree of traction. In sprint shoes spikes are used as tread elements which penetrate the surface of a running track in order to prevent slipping of the runner. Likewise, golf shoe comprise so called "spikes" which significantly increase the traction of the shoe in particular on grass due to their design.

The U.S. Pat. No. 7,730,637 B2 refers to a modular shoe which comprises a shoe upper with an upper side and a bottom side, a chassis releasably arranged inside the shoe upper, and a plurality of studs. Each stud is releasably attached to the chassis through the bottom side of the shoe upper. The bottom side of the shoe upper is clamped between the chassis and at least one of the attached studs.

The FR 2 813 766 refers to a shoe which comprises a sole with heightened sections below the sole and the heel. The shoe upper comprises openings in its bottom side, in which these heightened sections fit.

The U.S. Pat. No. 997,657 refers to a sports shoe or slipper with a solid outer sole which comprises a plurality of openings in its tread section and is equipped with a releasable and renewable tread element with a section, which is arranged in such a way to cover the inside of the outer sole tread section and which comprises pads that fit into the openings and protrude through the openings up to the outside of the outer sole.

The U.S. Pat. No. 8,813,387 B2 refers to an article of foot wear which includes a shoe upper and a sole structure. The shoe upper defines an internal cavity which is arranged to receive the sole structure and a foot. A lower surface of the shoe upper defines a plurality of openings and the sole structure includes a plurality of protrusions which protrude through the openings to form a ground contacting surface.

The WO 97/46127 refers to a method for the manufacturing of a shoe which includes the forming of a shoe upper, wherein the shoe upper includes a plurality of openings at its bottom side as well as an inner foot-shaped cavity. Next, a shoe outer sole is inserted into the inner cavity, so that sections of the outer sole protrude from the openings in the shoe upper and form an outer contact face of the shoe. The outer sole is connected to the shoe upper by gluing and/or stitching.

A disadvantage of known shoes, in particular sports shoes, is that they do not have a tread adaptable to the ground. Furthermore, another disadvantage is the weight of conventional shoes, in particular sports shoes, despite the effort for weight reduction, still comparably high. At the same time in shoes which are optimized with regard to their weight, the foot of a wearer is often not sufficiently supported.

The present invention relates to the problem to overcome the mentioned disadvantages of known shoes, in particular sports shoes.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a baseplate for a shoe is removably insertable into a shoe upper and comprises a substantially planar body, which is configured to provide stability to the shoe upper, and a plurality of tread elements, which are configured to protrude through a respective opening of a plurality of openings in a bottom portion of the shoe upper when the baseplate is removably inserted into the shoe upper, wherein the plurality of tread elements are unitarily formed with the body.

In certain embodiments, the body is stiff and rigid.

In some embodiments, the baseplate extends substantially throughout from a heel region of the shoe upper to a toe region of the shoe upper.

In certain embodiments, at least one of the plurality of tread elements comprises an undercut for the reception of a section of an edge of the respective opening of the plurality of openings in the bottom portion of the shoe upper to fix at least one of the plurality of tread elements relative to the bottom portion of the shoe upper. The undercut, in some embodiments, comprises a circumferential groove in at least one of the plurality of tread elements.

In some embodiments, the baseplate is manufactured in a 3D-printing process.

The arrangement, respective height and respective circumference of the plurality of tread elements, in certain embodiments, are adapted to the ground on which the shoe is used.

In certain embodiments, a first subset of the plurality of tread elements comprises studs and a second subset of the plurality of tread elements comprises plugs. The plugs, in some embodiments, are of such a height in comparison to the studs that the studs are configured to contact a flat ground while the plugs are not configured to contact the flat ground. In some embodiments, the plugs are configured to close the openings in the bottom portion of the shoe upper through which they protrude. The studs, in certain embodiments, are configured to close the openings in the bottom portion of the shoe upper through which they protrude.

In certain embodiments, each of the plurality of tread elements corresponds to an opening in the bottom portion of the shoe upper, such that there is a one-to-one correspondence between the tread elements and the openings.

In some embodiments, at least one stud comprises at least one groove extending in a vertical direction and is suitable to interact with a corresponding lug of a stud key.

The baseplate, in some embodiments, comprises a mounting device to fix the baseplate to the shoe upper. The mounting device, in certain embodiments, is at least a screw or a hook-and-loop tape.

In certain embodiments, the baseplate is made of polyamide, polyether-blockamide, PEBA or thermoplastic polyurethane, TPU.

The baseplate, in some embodiments, has at least one opening and/or cavity.

According to certain embodiments of the present invention, a shoe upper for a shoe, wherein the shoe upper is configured for the reception of a baseplate as described above, comprises a bottom portion with regions, wherein each of the regions comprises at least one opening of the plurality of openings, and each of the regions is more elastic than other regions of the bottom portion.

In some embodiments, at least some of the plurality of openings in the bottom portion of the shoe upper comprise a smaller diameter than the respective tread elements, which protrudes through the respective opening when the baseplate is removably inserted into the shoe upper.

Each region of the shoe upper, in some embodiments, comprises one opening, such that there is a one-to-one correspondence between the tread elements and the regions.

According to certain embodiments of the present invention, a shoe comprises the shoe upper described above.

According to certain embodiments of the present invention, a set of baseplates is formed as described above and each baseplate in the set of baseplates is different from every other baseplate in the set of baseplates at least in the arrangement and/or the design of the tread elements.

According to certain embodiments of the present invention, a method for manufacturing a baseplate, the baseplate comprising a plate-shaped, stiff and rigid body, and a plurality of tread elements, comprises forming the plate-shaped, stiff and rigid body, so that the body is configured to provide stability to the shoe upper when the baseplate is removably inserted into the shoe upper, and forming the plurality of tread elements in one piece with the body, so that the tread elements are configured to protrude through the respective opening of a plurality of openings in the bottom portion of the shoe upper when the complete baseplate is inserted into the shoe upper.

In some embodiments, the baseplate is manufactured in a 3D-printing process. The baseplate, in certain embodiments, is manufactured in an injection molding process.

In certain embodiments, during the method, at least one spacing-element is removably inserted between the baseplate and at least one of the plurality of tread elements to create an undercut for the reception of a section of an edge of the respective opening of the plurality of openings in the bottom portion of the shoe upper.

The plurality of tread elements, in some embodiments, is produced first and the baseplate is injection molded to the plurality of tread elements.

According to certain embodiments of the present invention, a baseplate comprises an upper surface for supporting the foot of a wearer and a bottom surface comprising at least one tread element integrally formed with the baseplate, wherein the baseplate is insertable into a shoe upper such that the at least one element protrudes through at least one opening in a bottom portion of the shoe upper.

In some embodiments, the baseplate is removable from the shoe upper. The baseplate, in certain embodiments, is configured to cover substantially all of the bottom portion of the shoe upper.

According to certain embodiments of the present invention, a modular shoe component comprises a baseplate comprising an upper surface for supporting the foot of a wearer and a bottom surface comprising one or more tread elements integrally formed with the baseplate, and a shoe upper for receiving the foot of a wearer comprising a bottom surface with one or more openings, wherein the baseplate is insertable into the shoe upper and the baseplate and the shoe upper are configured to allow the one or more tread elements each to project through the one or more openings of the shoe upper.

In some embodiments, the baseplate is removable from the shoe upper. The baseplate, in certain embodiments, is configured to cover substantially all of the bottom portion of the shoe upper

BRIEF DESCRIPTION OF THE DRAWINGS

The following detailed description, embodiments of the invention are described referring to the following figures.

BRIEF DESCRIPTION

Figure 1:
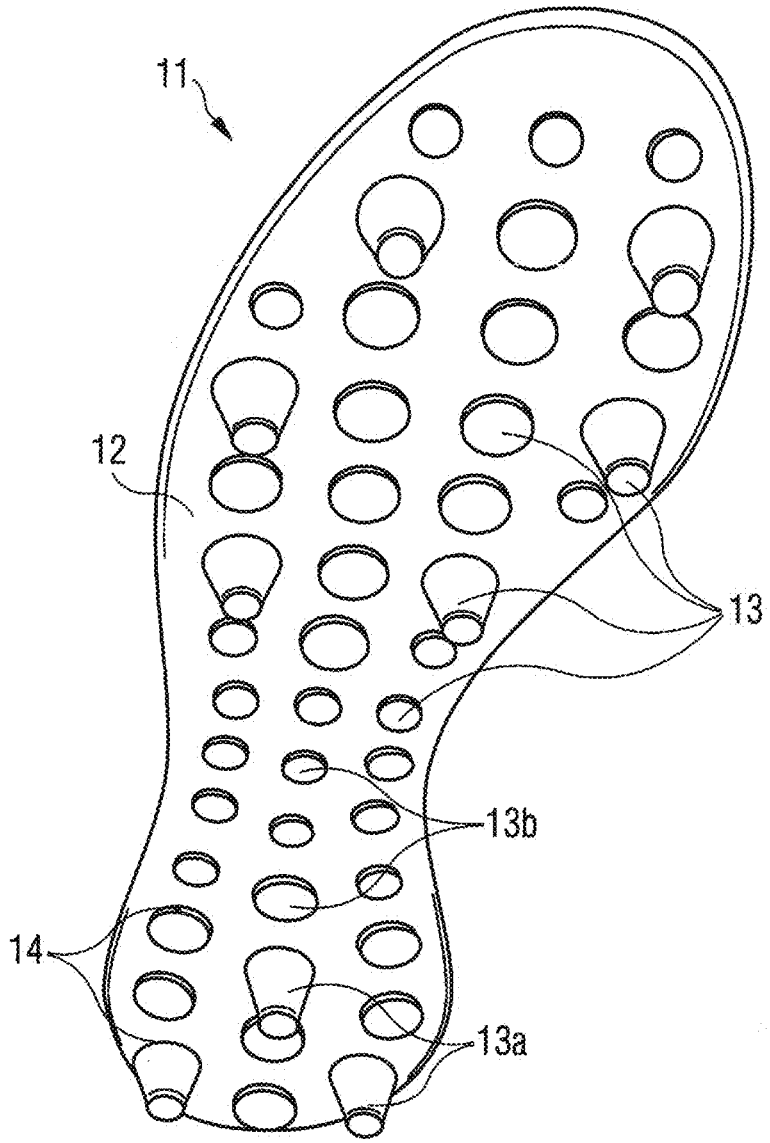
FIG. 1 is a perspective view of a baseplate, according to certain embodiments of the present invention.

According to the invention a baseplate for a shoe, in particular a sports shoe, is provided, wherein the baseplate is suitable to be inserted removably into a shoe upper, and wherein the baseplate comprises: (a.) a plate-shaped, stiff and rigid body which is suitable to provide stability to the shoe upper, (b.) a plurality of tread elements which are suitable to protrude through respective openings in a bottom portion of the shoe upper, if the baseplate is inserted into the shoe upper, (c.) wherein the tread elements are formed in one piece with the body.

Due to the fact that the baseplate is removably inserted into the shoe upper, another baseplate may be inserted into the shoe upper e.g. depending on the ground condition. In a football boot, a baseplate with relatively few but long tread elements in the shape of studs may be inserted, for example for the use on a grass field. On a cinder field however, a baseplate with relatively many, but preferably shorter, tread elements may be used. In some embodiments of the invention the baseplate is thus suitable to be inserted into a shoe upper of a football boot.

The arrangement and condition of the tread elements can furthermore be adapted depending on the requirements of the wearer of the shoe. In this manner, the shoe may be easily individualized regarding its tread-structure, wherein the same shoe upper may be used.

The baseplate according to the invention furthermore allows to provide a relative lightweight shoe which also supports the foot of a wearer sufficiently. A shoe comprising the baseplate according to the invention may comprise only the shoe upper and the baseplate. Given that the baseplate provides the necessary stability to the shoe and supports the foot of a wearer sufficiently due to its material properties, further components may be omitted, whereby the shoe becomes particularly lightweight. By way of example, the baseplate according to certain embodiments may comprise a flexural modulus of elasticity of at least 1000 $N/mm^2$, and further of at least 1200 $N/mm^2$. Furthermore, the baseplate comprises in some embodiments a drag modulus of elasticity of at least 1000 $N/mm^2$, and further of at least 1700 $N/mm^2$. A tensile strength of the baseplate is at least 40 $N/mm^2$, and further is at least 45 $N/mm^2$. A Charpy impact strength of the baseplate is at least 40 $kJ/mm^2$, and further is at least 53 $kJ/mm^2$.

The baseplate can extend throughout from a heel region of the shoe upper to a toe region of the shoe upper. Hereby the foot of a wearer is persistently supported. Further components, for example outer or midsoles, may be neglected if desired.

One of the plurality of tread elements may comprise an undercut for the reception of a section of an edge of an opening in the bottom portion of the shoe upper to fix the tread element relative to the bottom portion of the shoe upper. By this measure it may be prevented that the bottom portion of the shoe upper slips accidentally over at least one of the tread elements. Furthermore, a slipping of the baseplate in the shoe upper is prevented or at least the likelihood of such slippage is reduced.

The undercut may be a circumferential groove in the at least one tread element. A circumferential groove enables the fixation of the bottom portion of the shoe upper on all sides of the respective tread element.

The baseplate and/or the entire shoe may be manufactured in a 3D-printing process. With regard to the present invention, 3D-printing has the advantage that a baseplate individualized for the wearer of the shoe may be manufactured easy and cost-efficient. For example, the wearer of the shoe can design the tread-structure, i.e. the arrangement and size of the tread elements, by himself Another advantage of the 3D-printing is that the previously mentioned undercut may be created during the printing. Additional production steps, as for example milling, are not necessary.

The arrangement, the respective height and the respective circumference of the tread elements may be adapted to the ground on which the shoe is used. The shoe thus has the best possible traction on each ground.

A first subset of the plurality of tread elements may be studs and a second subset of the plurality of tread elements may be plugs. The plugs can comprise such a height in comparison to the studs that the studs are able to contact a flat ground, the plugs however not. The plugs prevent an intrusion of water and dirt from the bottom into the shoe upper, while the studs provide the necessary traction. In each of the openings of the bottom portion of the shoe upper can either be a stud or a plug.

The plugs may be suitable to close the openings in the bottom portion of the shoe upper through which they protrude. In this manner, an intrusion of water and dirt is prevented at the best. If another baseplate is inserted, for example a stud can protrude through the same opening which was closed by a plug before.

The studs may be suitable to close the openings in the bottom portion of the shoe upper through which they protrude as well. In this manner, an intrusion of water and dirt is prevented.

In general, according to the invention, each tread element may correspond to a certain opening in a bottom portion of a shoe upper, such that there is a one-to-one correspondence between the tread elements and the openings.

At least one stud may comprise at least one groove extending in a vertical direction and being suitable to interact with a corresponding lug of a stud key. Such a stud key may be used to clamp the bottom portion of the shoe upper in an undercut as will be described in more detail herein. The stud key may comprise at least one lug interacting with the groove. Thus, the groove may provide the function of a guiding means for the stud key.

The baseplate can comprise further a mounting device to fix the baseplate to the shoe upper. A slipping of the baseplate in the shoe upper is thereby reduced or prevented.

The mounting device may be at least a screw or a hook-and-loop tape. These types of mounting devices are easy to handle and fix the baseplate reliable.

The baseplate and/or the shoe upper may be equipped at least in parts with an anti-slip textile. Consequently a relative movement between the baseplate and the shoe upper may be prevented further. The anti-slip textile may be disposed in a forefoot region of the bottom portion of the baseplate and/or the shoe upper. In other examples another slip resistant element, e.g. a rubber element, may be provided.

The baseplate may be made of polyamide, polyether-block-amide (PEBA) or thermoplastic polyurethane (TPU). These materials are easy available and enable the manufacturing of a very durable baseplate. The baseplate may be made in particular of powdered polyamide 12. Elements made of polyamide 12 resist high mechanical or thermal strains. Furthermore, elements made of polyamide 12 provide the above mentioned material properties for example with regard to drag modulus of elasticity, tensile strength or flexural modulus of elasticity.

The baseplate can comprise at least an opening and/or a cavity. The opening and/or cavity could generally overlap with an opening in the bottom portion of the shoe upper or cover such an opening. In an overlap, air could stream from the outside of the shoe upper into the inside and vice versa to vent the foot.

The baseplate can also comprise regions with variable material thickness. So, there may be first regions which are thinner than second regions. Such thinner regions can serve to reduce a flexural strength or a stiffness in these regions.

A further aspect of the present invention relates to a shoe upper for a shoe, in particular a sports shoe, wherein the shoe upper is suitable for the reception of a baseplate as described before, and comprises a bottom portion with regions, wherein each of the regions comprises at least an opening, and each of the regions is more elastic than other regions of the bottom portion.

Due to the fact that the regions around the openings are more elastic than other regions of the shoe upper, the bottom portion of the shoe upper can close particularly well with the tread elements, which protrude through the openings. In this manner, on the one hand the intrusion of water and dirt may be prevented and on the other hand the baseplate is particularly well fixed relative to the shoe upper.

The regions of variable elasticity may be realized for example by means of a multi-layer structure of the bottom portion of the shoe upper. So, the bottom portion can comprise a base layer made of synthetic polyurethane, textile or knitted fabrics. On this base layer a top layer may be disposed, for example by means of HF bonding or heat compression molding. The base layer comprises the openings. If the top layer is omitted in regions around the openings, the regions of variable elasticity may be created particularly facile. The base layer has thereby a higher elasticity than the top layer. The top layer can comprise for example a TPU foil to increase an abrasion resistance of the bottom portion. It is also possible that more than three layers are disposed on top of each other to create the bottom portion.

Each of the openings in the bottom portion of the shoe upper can comprise a smaller diameter than the respective tread element, which protrudes through the respective opening, if the exchangeable baseplate is inserted into the shoe upper. Hereby the elastic regions are stretched and lie particularly tight to the tread openings, whereby the closure effect is strengthened even more.

The elastic regions may be arranged such that there are less elastic regions between elastic regions. The less elastic regions provide for that the bottom portion of the shoe upper is not stretched too much on the whole if the shoe is worn.

Each region may comprise one opening, such that there is a one-to-one correspondence between the tread elements and the regions.

Besides the bottom portion the shoe upper comprises an upper portion which encloses the foot of the wearer. The bottom portion and the upper portion may be manufactured independent of each other and permanently connected to each other afterwards. Such a connection may be achieved for example by means of sewing engineering or pinching. The shoe upper may be formed basically in two parts comprising the bottom and the upper. The bottom portion and the upper portion may be formed as well in one piece from the same material.

Yet a further aspect of the present invention relates to a shoe, in particular a sports shoe, which comprises a shoe upper and a baseplate as described before. As already explained, in the shoe according to the invention another baseplate may be inserted into the shoe upper, e.g. depending on the ground condition. Furthermore, according to the invention, a relative lightweight shoe may be provided which however supports the foot of a wearer sufficiently.

Still a further aspect of the present invention relates to a set of baseplates for a shoe, in particular a sports shoe, wherein each baseplate is formed as described before, and each baseplate in the set of baseplates is different to every other baseplate in the set of baseplates at least in the arrangement and the design of the tread elements.

The wearer of a shoe in whose upper one of the baseplates is inserted, can thus chose an appropriate baseplate, depending on the personal preferences or the ground condition, and insert it into the shoe upper. For example, in a set of baseplates for a football boot one baseplate at a time may be suitable particularly well for grass fields, one for cinder fields, one for sports halls, etc.

A distribution channel and a business model respectively of the baseplate according to the invention, the shoe upper according to the invention and the shoe according to the invention can include a separate sale of the individual components. The shoe upper can thereby directly adapted to a sportsperson and may be sold directly to him or her. Moreover separately a plurality of baseplates may be offered for sale separately. The baseplates may be sold separately or in sets. The baseplates can differ in particular with regard to the number and type of the tread elements, material, material constants, configuration in terms of color or graphical design. A customer who already bought a shoe upper separately, can buy at least one baseplates according to personal desires. It is also possible that a shoe upper is distributed together with a baseplate or a set of baseplates.

The baseplates may be printed either at home by the sportsperson him- or herself by means of a 3D-printer, may be ordered by the sportsperson online or may be bought in a shop. It is also possible that the baseplates may be created, in particular 3D-printed, in a shop immediate according to the customers or sportspersons desire. The baseplates may be supplied plain-colored or multi-colored and may be provided with design elements, for example by means of coating, flocking, laminating, sprinkling, bonding and/or printing, in the shop or by an end-user.

Yet, a further aspect of the present invention relates to a method for the manufacturing of a baseplate as described before, wherein the method comprises the steps: (a.) forming the plate-shaped body of the baseplate, and (b.) forming the plurality of tread elements in one piece with the body, so that the tread elements are suitable to protrude through the respective openings in the bottom portion of the shoe upper, if the complete baseplate is inserted into the shoe upper.

The baseplate may be manufactured in a 3D-printing process.

The baseplate can also be manufactured in an injection molding process. In such an injection molding process spacing elements in the shape of a ring-disk are inserted between tread elements and baseplate for creating the undercuts. Thereby at first the tread elements are produced, in some embodiments, of TPU. Afterwards the ring-disks are mounted to the tread elements. The ring-disks are thereby mounted in a region of the tread elements that is located adjacent to the baseplate to be injection molded. For the mounting of the ring-disks for example a pen-like protrusion of the tread elements is suitable. Afterwards the baseplate, in some embodiments made of PA, is injection molded to the tread elements. By the arrangement of the ring disks between tread elements and baseplate the undercuts are created. After the injection molding of the baseplate the ring disks may be removed again. It is in principle also possible to produce the baseplate at first and afterwards injection mold the tread elements to the baseplate, by use of the ring disks.

The ring disks are in some embodiments made of a material which does not tend towards bonding with the material of the baseplate or the tread elements. Such a material is for example Teflon.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIG. 1 shows a baseplate 11 for a shoe, in particular a sports shoe, according to certain embodiments of the present invention. The baseplate 11 comprises a plate-shaped, stiff and rigid body 12, which is suitable to provide stability to the shoe upper. Due to the plate shape, the baseplate 11 may be removably inserted into a shoe upper. The body 12 of the baseplate 11 is stiff and rigid such that it can provide the necessary stability for a shoe to the shoe upper.

The baseplate 11 may be made of plastic material as for example polyamide, polyether-block-amide (PEBA) or thermoplastic polyurethane (TPU). The baseplate 11 may be manufactured e.g. by means of an injection molding or by means of a 3D-printer.

According to certain embodiments, as shown in FIG. 1, the baseplate 11 comprises a plurality of tread elements, of whom eight are labeled by the reference sign 13, 13*a* and 13*b* respectively. The tread elements 13, 13*a* and 13*b* are suitable to protrude through respective openings in a bottom portion of a shoe upper, if the baseplate 11 is inserted into the shoe upper. In these embodiments, the tread elements 13, 13*a* and 13*b* may comprise a circular cross section. Generally, the tread elements 13, 13*a* and 13*b* can comprise different cross sectional shapes, as for example triangular, quadrangular, oval, elliptical-shaped and so forth.

The tread elements 13, 13*a* and 13*b* are formed in one piece with the body 12. For example, the tread elements 13, 13*a* and 13*b* may be formed in one piece with the body 12 by means of an injection molding. In case a 3D-printer is used for the manufacturing of the baseplate 11, the tread elements 13, 13*a* and 13*b* are formed in one piece with the body 12, by forming the baseplate 11 layer by layer in the printer.

In some embodiments, the baseplate 11 comprises two different types of tread elements. A first subset of the plurality of tread elements are studs, of which two are labeled with the reference sign 13*a*. The second subset of the plurality of tread elements are plugs, of which two are labeled with the reference sign 13*b*. In general, according to the invention, each stud 13*a* and plug 13*b* may correspond to a certain opening in a bottom portion of a shoe upper as will be described in more detail below.

The studs 13*a* are frustum-shaped in certain embodiments, as shown in FIG. 1. Other shapes are possible, as for example cone-shaped, pyramidal, hemispherical, rib-shaped and so forth. The plugs 13*b* comprise a flattened shape in FIG. 1. Here as well generally different shapes are possible. In general, the plugs 13*b* comprise such a height in comparison to the studs 13*a* that the studs 13*a* are able to contact a flat ground, the plugs 13*b* however not. Therefore the plugs 13*b* are suitable to close the openings in the shoe upper through which they protrude. The studs 13*a* have in particular the function to provide the necessary traction on soft ground, by intruding into the ground up to a certain degree. It should be noted that the studs 13*a* may also be suitable to close the openings in the bottom portion of the shoe upper through which they protrude.

Generally, the arrangement, the respective height and the respective circumference of the tread elements 13, 13*a* and 13*b* may be adapted to the ground on which the shoe, in whose upper the baseplate 11 is inserted, is used. For example in a football boot a baseplate with few, but instead relative long studs may be inserted, if the football boot is used on a grass field. In using the football boot on a cinder field a baseplate with many, but instead shorter studs may be inserted.

At least one of the plurality of tread elements 13, 13*a* and 13*b* can comprise an undercut for the reception of a section of an edge of an opening in the bottom portion of the shoe upper to fix the tread element relative to the bottom portion of the shoe upper. This is true for the embodiments of the tread elements of FIG. 1, in which two such undercuts are labeled with the reference sign 14. The undercuts in FIG. 1 are circumferential grooves in the respective tread elements 13, 13*a* and 13*b*. The undercuts 14 in FIG. 2 may be formed like the undercuts 14 shown in FIG. 1.

The undercuts 14 can for example be milled into the respective tread elements, for example if the baseplate 11 is manufactured by means of an injection molding.

Figure 2:
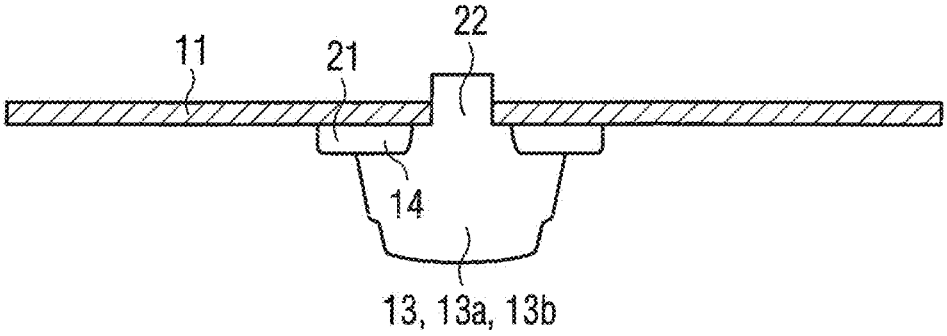
FIG. 2 is a cross-sectional view of a tread element, according to certain embodiments of the present invention.

The undercuts 14 can also be created in a multi-stage injection molding, as shown in FIG. 2, in which spacing elements in the shape of ring disks 21 are inserted between tread elements 13, 13*a* and 13*b* and baseplate 11 for creating the undercuts 14. Thereby, at first the tread elements 13, 13*a* and 13*b* are produced. In the following, the ring disks 21 are mounted to pen-like protrusions 22 of the tread elements 13, 13*a* and 13*b*. Afterwards, the baseplate 11 is injection molded to the tread elements 13, 13*a*, and 13*b*. Due to the arrangement of the ring disks 21 between the tread elements 13, 13*a* and 13*b* and baseplate 11, the undercuts 14 are created. After the injection molding of the baseplate 11, the ring disks 21 may be removed again. Generally it is also possible to manufacture the baseplate 11 at first and afterwards injection mold the tread elements 13, 13*a* and 13*b*, by use of the ring disks 21, to the baseplate. The ring disks 21 are in some embodiments made of a material which tends not towards bonding with the material of the baseplate 11 or of the tread elements 13, 13*a* and 13*b*. Such a material is for example teflon.

In certain cases, manufacturing of the baseplate 11 (and/or the entire shoe) with a 3D-printer may be beneficial because, in this case, the undercuts 14 may be created during the printing process, and without that, a further production step (e.g. milling) is necessary.

Figure 3:
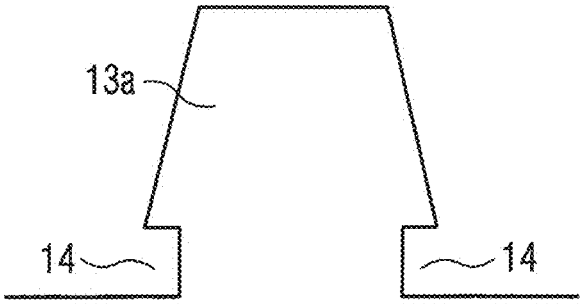
FIG. 3 is a schematic cross-sectional view of a stud, according to certain embodiments of the present invention.

FIG. 3 shows a cross section of a stud 13*a* with the undercut 14. It should be noted that the plugs 13*b* may comprise similar undercuts 14 as the stud 13*a* shown in FIG. 3.

Figure 4:
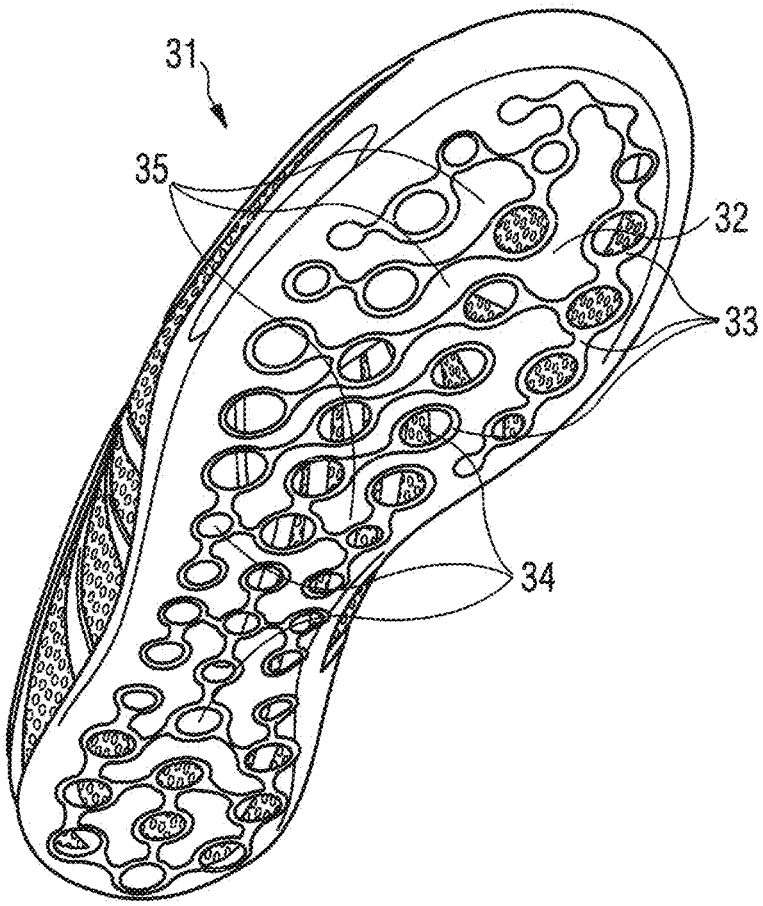
FIG. 4 is a perspective view of a shoe upper, according to certain embodiments of the present invention.

The FIG. 4 shows a shoe upper 31 for a shoe, in particular a sports shoe, according to certain embodiments of the present invention. The shoe upper 31 comprises a bottom portion 32 with a plurality of regions of which three are exemplary labeled with the reference sign 33. Each of the regions 33 comprises an opening of which three are exemplary labeled with the reference sign 34 in the FIG. 1. Each of the regions 33 is more elastic than other regions of the bottom portion 32. In FIG. 4, three such other regions are labeled with the reference sign 35. Generally, according to certain embodiments of the invention the regions of the bottom portion 32 of the shoe upper 31 are more elastic around the openings 34 than the regions 35 between the openings 34.

The regions 33 may be connected or separated from each other. If the regions 33 are separated from each other, there is at least one other less elastic region 35 between two elastic regions 33. In certain embodiments, each of the regions 33 may be assigned to one certain stud 13*a* or plug 13*b*, i.e. each region 33 comprises exactly one stud 13*a* or plug 13*b*.

The shoe upper 31 is suitable to receive a baseplate 11, as it was described before with reference to the FIG. 1. Due to the fact that the bottom portion 33 of the shoe upper 31 is more elastic around the opening 34, the edge of each opening 34 firmly abuts against the respective tread element 13, 13*a* and 13*b*, which protrudes through the respective opening 34. In order that the bottom portion 32 of the shoe upper 31 closes particularly well with the tread elements 13, 13*a* and 13*b*, each of the openings 34 in the bottom portion 32 of the shoe upper 31 can comprise a smaller diameter than the respective tread element 13, 13*a* and 13*b*, which protrudes through the respective opening 34, if the exchangeable baseplate 11 is inserted into the shoe upper 31.

Figure 5:
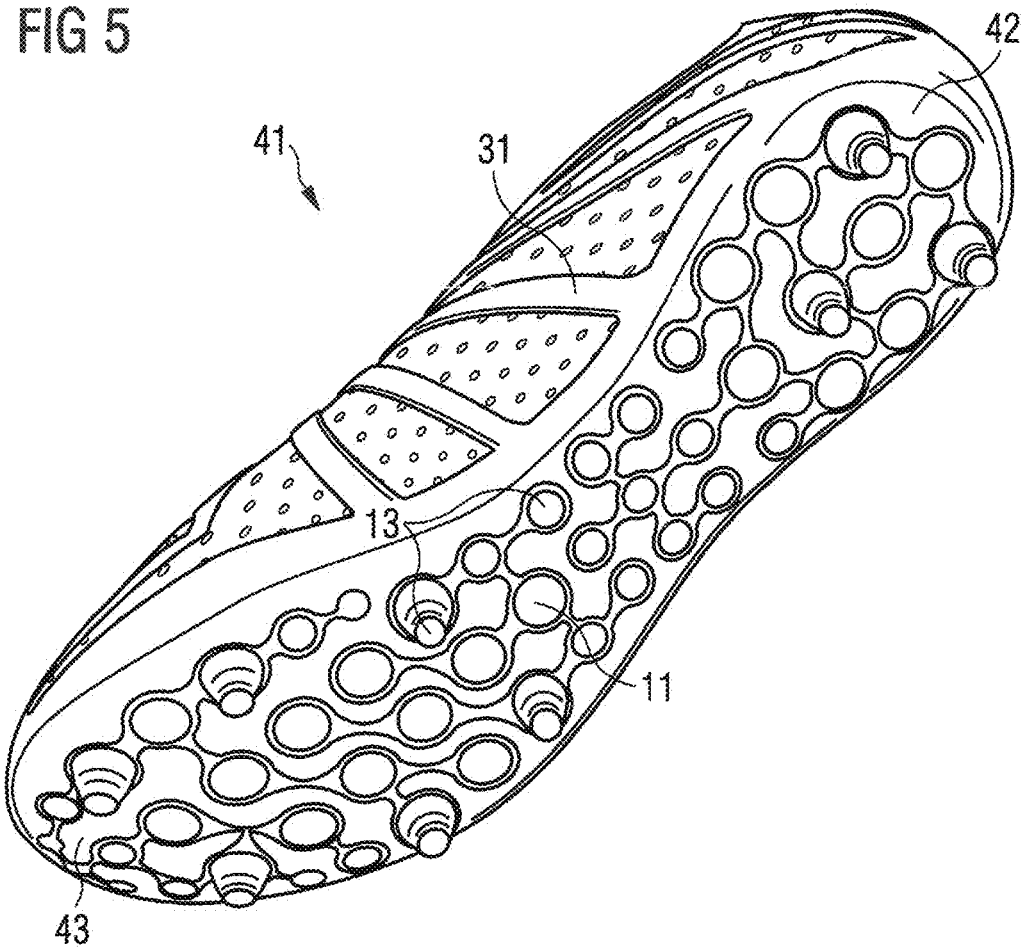
FIG. 5 is a perspective view of a shoe, according to certain embodiments of the present invention.

FIG. 5 shows a shoe 41 according to certain embodiments of the present invention, which is in particular a sports shoe. The shoe 41 comprises a shoe upper 31 as it was described in connection with the FIG. 4, and a baseplate 11 as it was described in connection with the FIG. 1. The baseplate 11 is inserted into the shoe upper 31 such that the tread elements, of which two are labeled with the reference sign 13 in the FIG. 5, protrude through the openings 34. In FIG. 5, the baseplate 11 extends throughout from a heel region 342 of the shoe upper to a toe region 443 of the shoe upper 31.

In order to fix the baseplate 11 to the shoe upper 31, the baseplate 11 can comprise a mounting device (not shown in the Figs). The mounting device may be for example a screw, textile material, rubber material or a hook-and-loop-tape. If a screw is used, a respective screw thread may be located in the bottom portion 32 of the shoe upper 31, in which the screw is screwed, to fix the baseplate 11 between the screw head and the bottom portion 32 of the shoe upper 31. Alternatively, the screw thread may be located in the baseplate 11 and the screw is screwed into the screw thread through an opening in the bottom portion 32 of the shoe upper 31 to fix the bottom portion 32 of the shoe upper 31 between the screw head and the baseplate 11. If a hook-and-loop tape is used as a mounting device, the baseplate 11 can comprise a hook-and-loop tape at its bottom portion, and a respective counterpart may be at the bottom portion 32 of the shoe upper 31 inside the shoe upper 31.

Figure 6A:
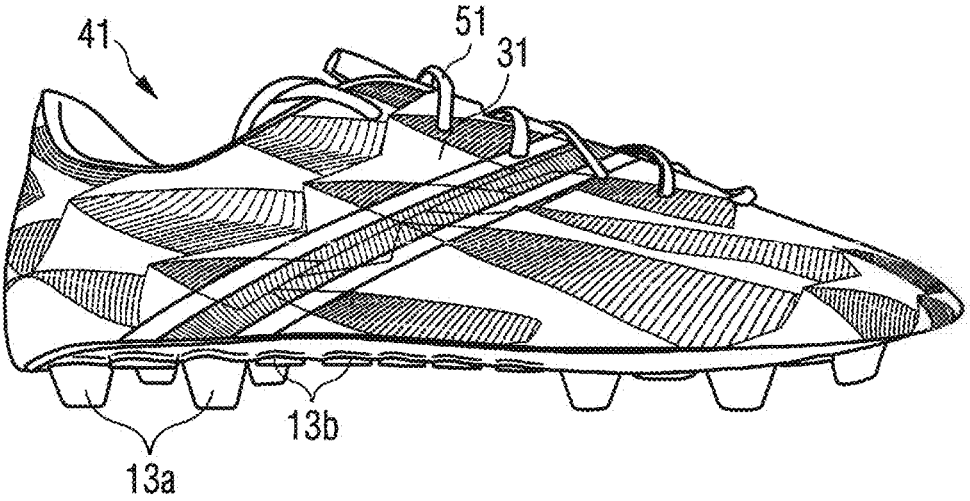
FIGS. 6*a* and 6*b* are perspective views of a shoe, according to certain embodiments of the present invention.
Figure 6B:
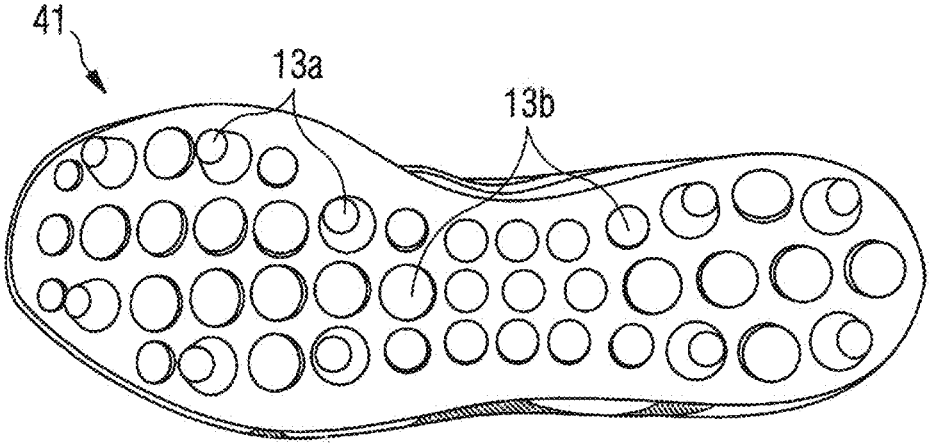

The FIGS. 6A and 6B show embodiments of a shoe 41 according to the present invention. Thereby FIG. 6A shows the shoe 41 from the side, while the FIG. 6B shows the shoe 41 from below. In the FIG. 6A the different height of the studs 13*a* in comparison to the height of the plugs 13*b* is clearly visible. The studs 13*a* contact the ground, the plugs 13*b* however not. In the embodiments of FIGS. 6A and 6B the shoe upper 31 comprises a cording 51. Other fixation devices as for example hook-and-loop fastener or zippers, however, are also possible.

Figure 7:
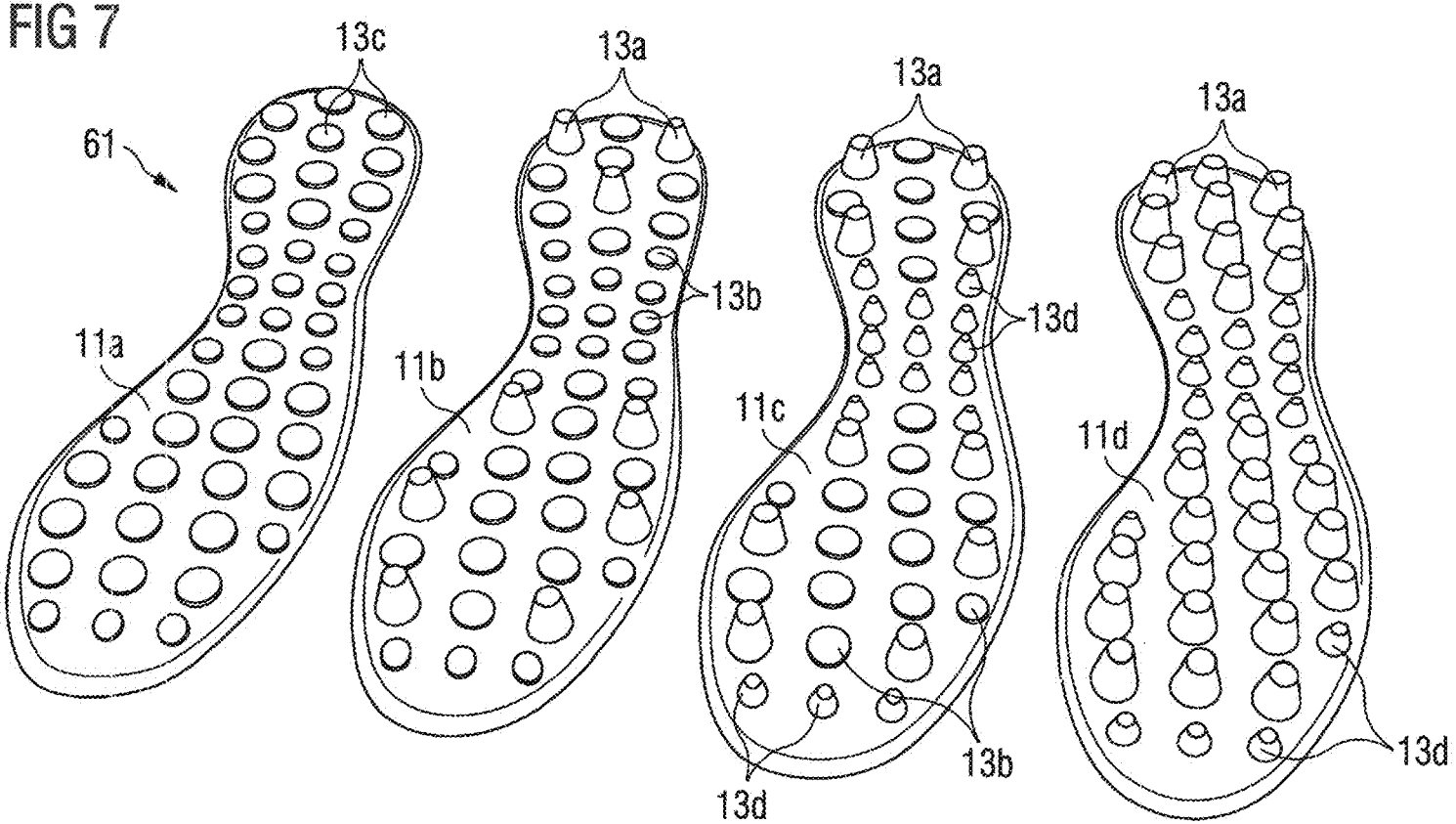
FIG. 7 is a perspective view of baseplates, according to certain embodiments of the present invention.

The FIG. 7 shows embodiments 61 of baseplates 11*a*, 11*b*, 11*c* and 11*d* for a shoe, in particular a sports shoe. Each of the shown baseplates 11*a*, 11*b*, 11*c* and 11*d* is formed as previously described. Each of the baseplates 11*a*, 11*b*, 11*c* and 11*d* in the set 61 of baseplates differs from every other baseplate 11*a*, 11*b*, 11*c* and 11*d* in the set 61 of baseplates at least in the arrangement and design of the tread elements 13, 13*a* and 13*b*. Thus, the baseplate 11*a* has constant flat, plate-shaped tread elements 13*c*. If such a baseplate 11*a* is inserted for example into an appropriate shoe upper 31 for a football boot, the respective football boot would be particularly well suited for a hard ground, for example a cinder field. Furthermore, such a shoe that has a baseplate 11*a* with solely flat, plate-shaped tread elements 13*c* in the shape of plugs, may be also used as a walking-shoe. Thus it is possible that a shoe upper is used for example in combination with a first baseplate as a football boot and in combination with a second baseplate as a walking-shoe.

If the baseplate 11*b* is inserted into the appropriate shoe upper 31 for a football boot, the respective football boot would be particularly well suited for a soft ground, as for example a grass field. The baseplate 11*c* comprises three different types of tread elements, namely long studs 13*a*, plugs 13*b* and short studs 13*d*. The baseplate 11*c* would be suitable for a football boot which is used on medium-hard up to hard ground. The baseplate 11*d* comprises two different types of tread elements 13, namely long studs 13*a* and short studs 13*d*. The baseplate 11*d* is suitable for a football boot which is used on medium-hard up to soft ground.

According to the invention, the wearer of a shoe 41 according to the invention can thus change the baseplate 11 depending on the condition of the ground on which the shoe 41 is worn. It is also possible to change the baseplate 11 at the time when the tread elements 13 are worn out due to abrasion up to a certain degree.

Figure 8:
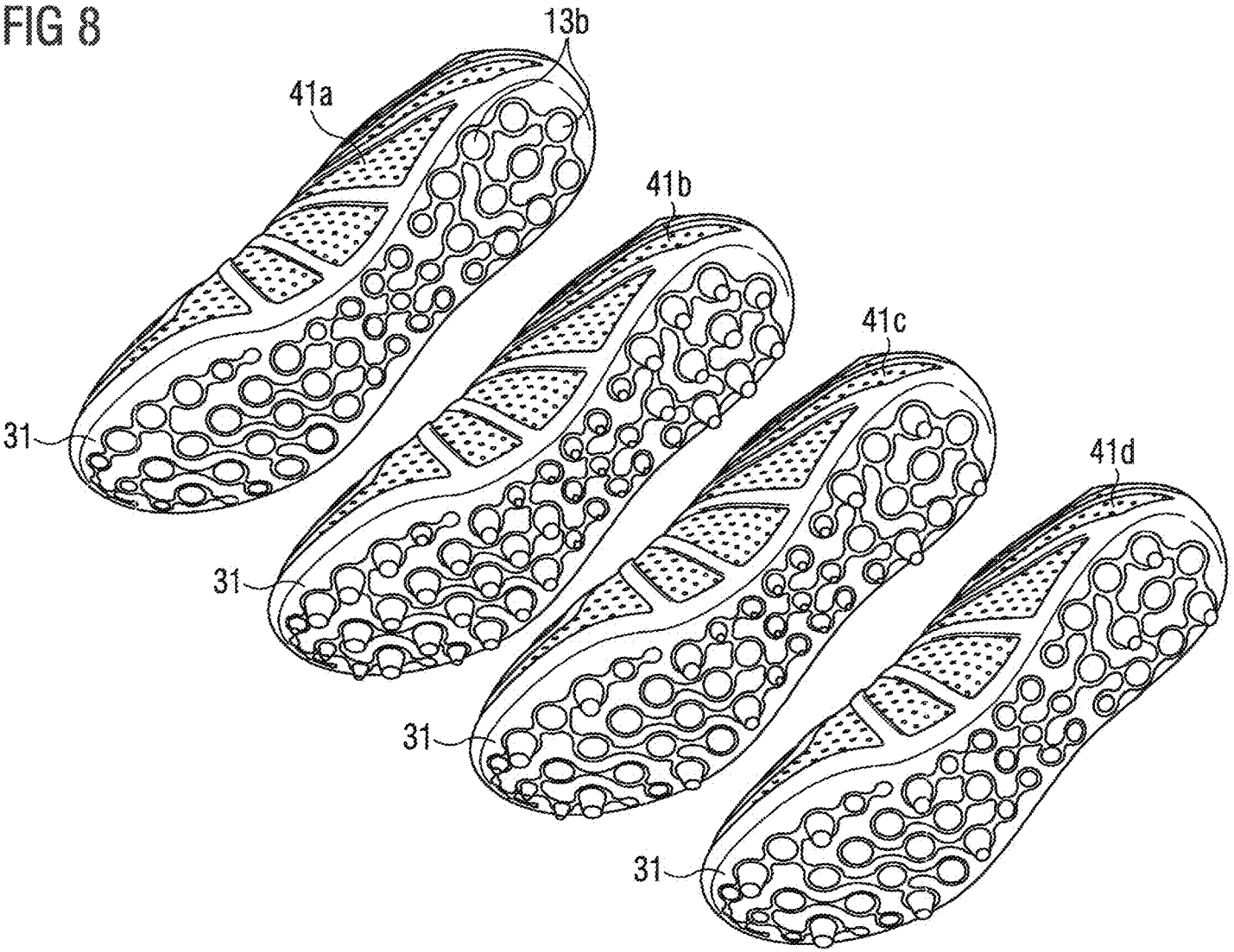
FIG. 8 is a perspective view of shoes, according to certain embodiments of the present invention.

The FIG. 8 shows embodiments of shoes 41*a*, 41*b*, 41*c* and 41*d* according to the present invention. The shoes 41*a*, 41*b*, 41*c* and 41*d* each comprise a shoe upper 31 as described before. Into the shoe upper 31 a different baseplate 11 is inserted at a time. Thus the shoe 41*a* comprises a baseplate which comprises plugs 13*b* as tread elements from end-to-end. The shoe 41*b* comprises the baseplate 13*d* shown in FIG. 7, which comprises studs 13*a* and 13*d* from end-to-end. The shoe 41*c* comprises the baseplate 11*c* shown in FIG. 7, which comprises long studs 13*a*, plugs 13*b* and short studs 13*d*. Finally, the baseplate 11*b*, which comprises studs 13*a* and plugs 13*b*, shown in FIG. 7 is inserted into the upper 31 of the shoe 41*d*. As already mentioned, in this manner according to the invention a football boot may be obtained whose tread is adapted to the respective ground.

Figure 9:
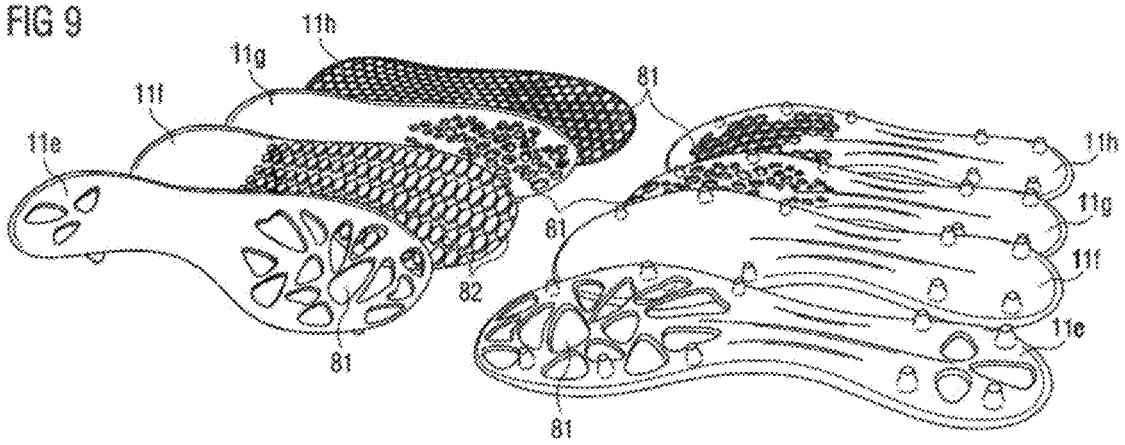
FIG. 9 is a perspective view of baseplates, according to certain embodiments of the present invention.

The FIG. 9 shows further embodiments of baseplates 11*e*, 11*f*, 11*g* and 11*h* according to the present invention. The baseplates 11*e*, 11*f*, 11*g* and 11*h* thereby comprise openings 81. These openings 81 can at least partially overlap with at least an opening in the bottom portion 32 of the shoe upper 31, in which the respective baseplate 11*e*, 11*f*, 11*g*, and 11*h* is inserted. In this manner the circulation of air may be improved.

The openings 81 can also provide for adjusting the stiffness of the respective baseplate 11*e*, 11*f*, 11*g* and 11*h*. For example, the baseplate 11*h* has a lot of openings 81 in the forefoot region. This increases the flexibility of the baseplate 11*h* in the toe region and enables a more facile rolling up of the foot. The shoe upper 11*f* shown in FIG. 9 has no openings, but a number of pimples of which two are exemplary labeled with the reference sign 82.

The baseplates 11*e*, 11*f*, 11*g* and 11*h* can also comprise regions with variable material thickness, in particular cavities, instead of openings. Thus, first regions may be provided which are thinner than second regions. Such thinner regions can provide for reducing a flexibility or a stiffness in these regions.

Figure 10:
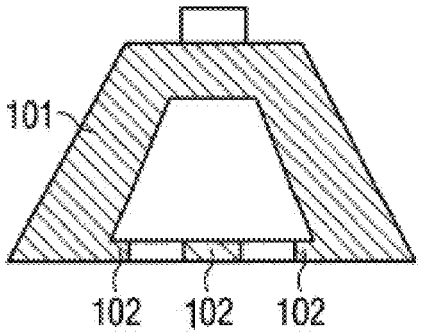
FIG. 10 is a schematic cross-sectional view of a stud key, according to certain embodiments of the present invention.
Figure 11:
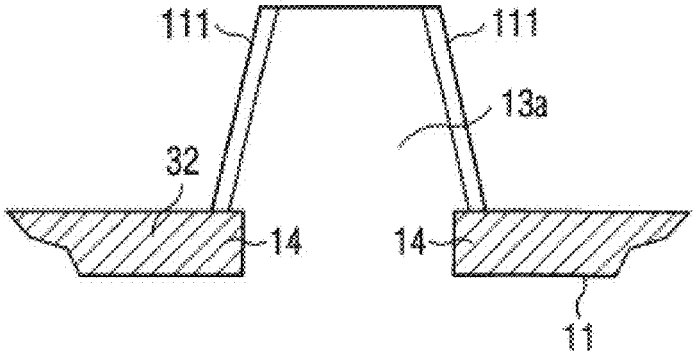
FIG. 11 is a schematic cross-sectional view of a stud, according to certain embodiments of the present invention.

FIG. 10 shows a stud key. The stud key 101 helps to lock the bottom portion 32 of a shoe upper under the undercuts 14 as shown in FIG. 11. The stud key 101 comprises lugs 102 on an internal surface thereof. The lugs 102 interact with corresponding grooves 111 on the stud 13*a*. As will be described in more detail with respect to FIGS. 14A to 14D, the stud key 101 is moved downwards along a longitudinal axis of the stud, wherein the lugs 102 are guided by the grooves 111. The lugs 102 press down the bottom portion 32 of the shoe upper so that the bottom portion 32 is fixed under the undercuts 14. While pressing down the bottom portion 32, the stud key 32 may be rotated to press down the bottom portion 32 in the entire area around the respective stud.

Figure 12:
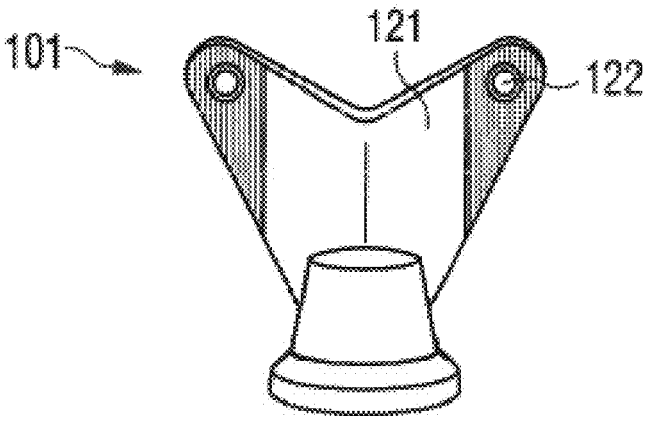
FIG. 12 is a cross-sectional view of a stud key, according to certain embodiments of the present invention.

FIG. 12 shows a stud key 101 with a wing-shaped handle 121 having a bore 122 to attach the stud key 101 e.g. to a key ring, according to certain embodiments of the present invention.

Figure 13:
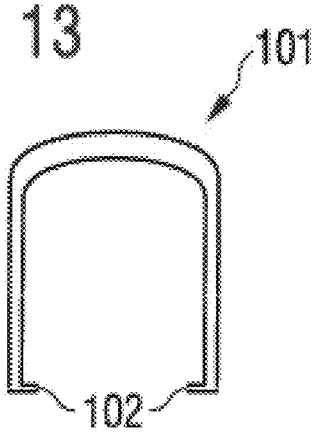
FIG. 13 is a cross-sectional view of a stud key, according to certain embodiments of the present invention.

As shown in FIG. 13, the stud key 101 may alternatively have a clamp-shape with lugs 102 at its open ends.

Figure 14A:
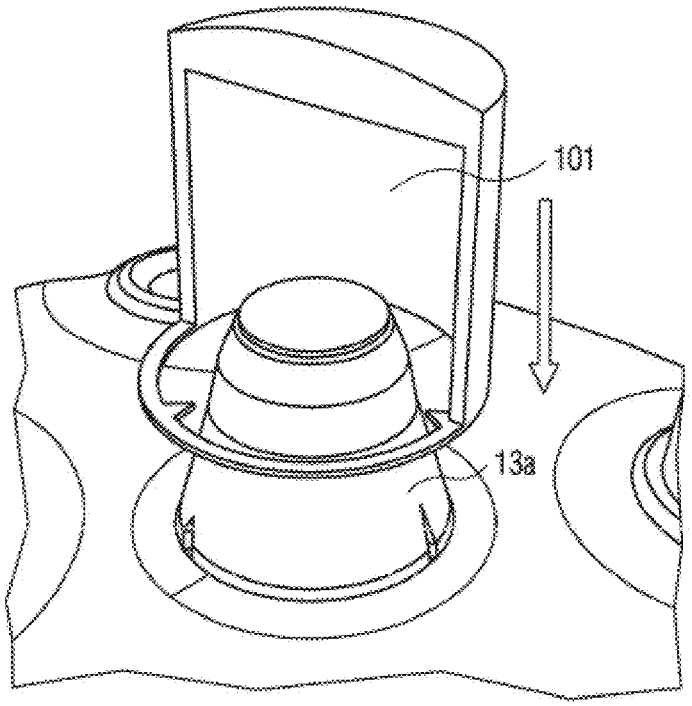
FIGS. 14*a*, 14*b*, 14*c* and 14*d* illustrate a method of manufacturing a shoe, according to certain embodiments of the present invention.
Figure 14B:
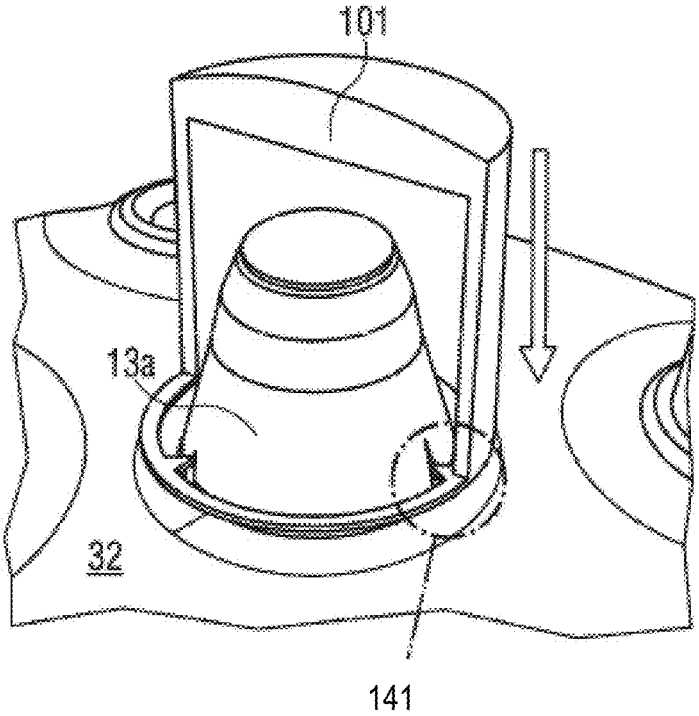
Figure 14C:
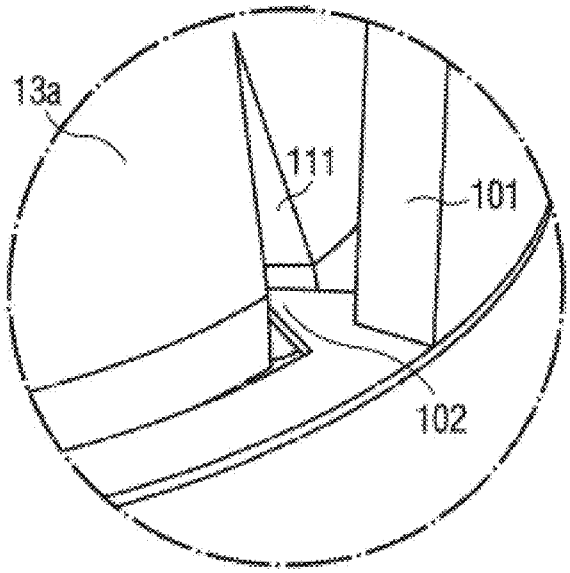
Figure 14D:
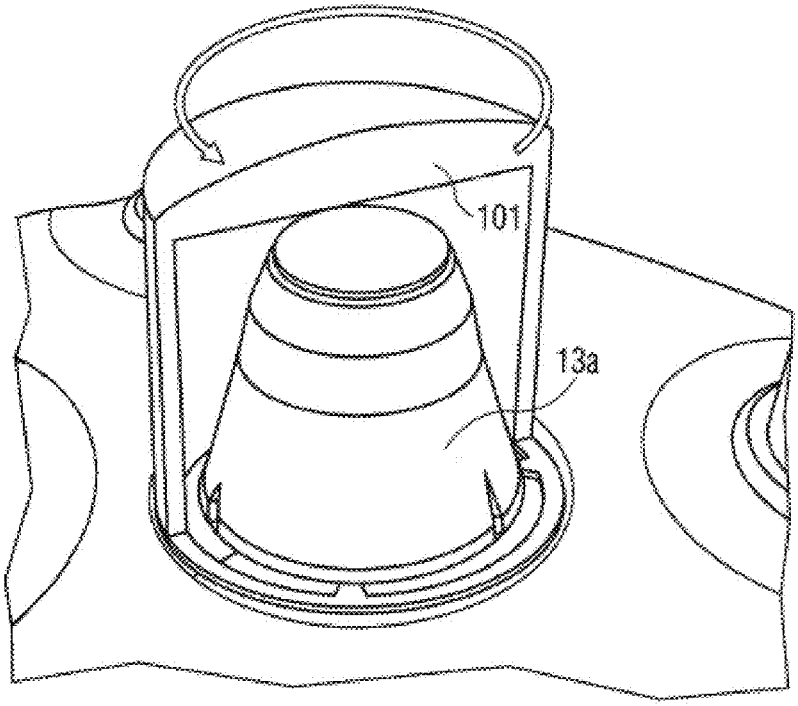

FIGS. 14A to 14D show the usage of the stud key 101 in more detail. It should be noted that the stud key 101 is shown in a sectional view for illustrative purposes. In a first step shown in FIG. 14A the stud key 101 is positioned over a stud 13*a* and moved along a longitudinal axis of the stud 13*a* as indicated by the arrow in FIG. 14A. The stud key 101 is possibly guided by lugs 102 which interact with corresponding grooves 111 in the stud 13*a* as shown in detail in FIG. 14C. In FIG. 14B the stud key 101 has been moved along the stud 13*a* until its bottom portion touches the bottom portion 32 of the shoe upper. The lugs 102 are still engaged with the grooves 111 of the stud 13*a* as may be seen in more detail in FIG. 14C which is a close-up view of the encircled area 141 in FIG. 14B. If the stud key 101 is moved further, it presses down the bottom portion 32 of the shoe upper until the bottom portion 32 is clamped under the undercut 14 of the stud 13*a* as shown in FIG. 11. If the stud key 101 is pushed down hard enough, the lugs 102 will finally leave the grooves 111 at the bottom portion of the respective groove 111. The lugs 102 then protrude into the undercuts 14 and the stud key may be rotated as indicated in FIG. 14D by the arrow. Thus, the bottom portion 32 of the shoe upper may be pressed down and clamped under the undercut in the entire area around the respective stud 13*a*. After the bottom portion 32 of the shoe upper has been clamped under the undercut, the stud key 101 may be rotated in a position, such that each lug 102 is aligned with a respective groove 111. The stud key 101 may then be removed from the stud 13*a* with the grooves 111 guiding the respective lugs 102.

What has been said above with respect to a stud 13*a* is valid for a plug 13*b* as well, i.e. the stud key 101 may be used as well to clamp the bottom portion 32 of a shoe upper under the undercut of a plug 13*b*. Alternatively, a separate plug key may be used with a shape that is especially adapted to fit a plug 13*b*.

Generally, features of different exemplary embodiments described herein may be combined to obtain a further embodiments of the present invention.

In the following, further examples are described to facilitate the understanding of the invention:

1. Baseplate (11) for a shoe, in particular a sports shoe, wherein the baseplate (11) is suitable to be removably inserted into a shoe upper, and wherein the baseplate (11) comprises:
a. a plate-shaped, stiff and rigid body (12), which is suitable to provide stability to the shoe upper;
b. a plurality of tread elements (13, 13*a*, 13*b*, 13*c*, 13*d*), which are suitable to protrude through respective openings in a bottom portion of the shoe upper, if the baseplate (11) is inserted into the shoe upper,
c. wherein the tread elements (13, 13*a*, 13*b*, 13*c*, 13*d*) are formed in one piece with the body (12).
2. Baseplate (11) according to the preceding example, wherein the baseplate (11) extents throughout from a heel region (42) of the shoe upper to a toe region (43) of the shoe upper.
3. Baseplate (11) according to one of the preceding examples, wherein at least one of the plurality of tread elements (13, 13*a*, 13*b*, 13*c*, 13*d*) comprises an undercut (14) for the reception of a section of an edge of an opening in the bottom portion of the shoe upper to fix the tread element (13, 13*a*, 13*b*, 13*c*, 13*d*) relative to the bottom portion of the shoe upper.
4. Baseplate (11) according to the preceding example, wherein the undercut (14) is a circumferential groove in the at least one tread element (13, 13*a*, 13*b*, 13*c*, 13*d*).
5. Baseplate (11) according to any one of the preceding examples, wherein the baseplate (11) is manufactured in a 3D-printing process.
6. Baseplate (11) according to any one of the preceding examples, wherein the arrangement, the respective height and the respective circumference of the tread elements (13, 13*a*, 13*b*, 13*c*, 13*d*) is adapted to the ground on which the shoe is used.
7. Baseplate (11) according to any one of the preceding examples, wherein a first subset of the plurality of tread elements (13, 13*a*, 13*b*, 13*c*, 13*d*) are studs (13*a*, 13*c*, 13*d*) and a second subset of the plurality of tread elements (13, 13*a*, 13*b*, 13*c*, 13*d*) are plugs (13*b*).
8. Baseplate (11) according to the preceding example, wherein the plugs (13*b*) provide such a height in comparison to the studs (13*a*, 13*c*, 13*d*) that the studs (13*a*, 13*c*, 13*d*) are able to contact a flat ground, the plugs however not.
9. Baseplate (11) according to any one of the preceding examples 7 to 8, wherein the plugs (13*b*) are suitable to close those openings in the bottom portion of the shoe upper through which they protrude.
10. Baseplate (11) according to any one of the preceding examples 7 to 9, wherein the studs (13*a*, 13*c*, 13*d*) are suitable to close those openings in the bottom portion of the shoe upper through which they protrude.
11. Baseplate (11) according to any one of the preceding examples, wherein each tread element (13, 13*a*, 13*b*, 13*c*, 13*d*) corresponds to an opening in the bottom portion of the shoe upper, such that there is a one-to-one correspondence between the tread elements (13, 13*a*, 13*b*, 13*c*, 13*d*) and the openings.
12. Baseplate (11) according to any one of the preceding examples 7 to 11, wherein at least one stud (13*a*, 13*c*, 13*d*) comprises at least one groove (111) extending in a vertical direction and being suitable to interact with a corresponding lug (102) of a stud key (101).
13. Baseplate (11) according to any one of the preceding examples, further comprising a mounting device to fix the baseplate (11) to the shoe upper.

14. Baseplate (11) according to the preceding example, wherein the mounting device is at least a screw or a hook-and-loop tape.
15. Baseplate (11) according to any one of the preceding examples, wherein the baseplate (11) is made of polyamide, polyether-block-amide, PEBA or thermoplastic polyurethane, TPU.
16. Baseplate (11) according to any one of the preceding examples, wherein the baseplate (11) comprises at least one opening (81) and/or a cavity.
17. Shoe upper (31) for a shoe, in particular a sports shoe, wherein the shoe upper (31) is suitable for the reception of a baseplate (11) according to one of the claims 1 to 16, and comprises:
    a bottom portion (32) with regions (33), wherein
    each of the regions (33) comprises at least one opening (34), and
    each of the regions is more elastic than other regions (35) of the bottom portion (32).
18. Shoe upper (31) according to example 17, wherein each of the openings (34) in the bottom portion (32) of the shoe upper (31) comprises a smaller diameter than the respective tread element (13, 13*a*, 13*b*, 13*c*, 13*d*), which protrudes through the respective opening (34), if the removable baseplate (11) is inserted into the shoe upper (31).
19. Shoe upper (31) according to any one of examples 17 to 18, wherein each region (33) comprises one opening (34), such that there is a one-to-one correspondence between the tread elements (13, 13*a*, 13*b*, 13*c*, 13*d*) and the regions (33).
20. Shoe (41, 41*a*, 41*b*, 41*c*, 41*d*), in particular a sports shoe, comprising:
a. a shoe upper (31) according to any one of the examples 14 to 15; and
b. a baseplate (11) according to any one of the examples 1 to 16.
21. A set (61) of baseplates (11*a*, . . . , 11*d*; 11*e*, . . . , 11*h*) for a shoe, in particular a sports shoe, wherein
a. each baseplate (11*a*, . . . , 11*d*; 11*e*, . . . , 11*h*) is formed according to any one of the examples 1 to 16, and
b. each baseplate (11*a*, . . . , 11*d*; 11*e*, . . . , 11*h*) in the set (61) of baseplates (11*a*, . . . , 11*d*; 11*e*, . . . , 11*h*) is different to every other baseplate (11*a*, . . . , 11*d*; 11*e*, . . . , 11*h*) in the set (61) of baseplates (11*a*, . . . , 11*d*; 11*e*, . . . , 11*h*) at least in the arrangement and the design of the tread elements (13, 13*a*, 13*b*, 13*c*, 13*d*).
22. Method for the manufacturing of a baseplate (11) according to any one of the examples 1 to 16, wherein the method comprises the steps:
a. forming the plate-shaped, stiff and rigid body (12), so that this one is suitable to provide stability to the shoe upper (31), if the baseplate (11) is inserted into the shoe upper; and
b. forming the plurality of tread elements (13, 13*a*, 13*b*, 13*c*, 13*d*) in one piece with the body (12), so that the tread elements (13, 13*a*, 13*b*, 13*c*, 13*d*) are suitable to protrude through the respective openings (34) in the bottom portion (32) of the shoe upper (31), if the complete baseplate (11) is inserted into the shoe upper (31).
23. Method according to the preceding example, wherein the baseplate (11) is manufactured in a 3D-printing process.
24. Method according to example 22, wherein the baseplate is manufactured in an injection molding process.
25. Method according to example 24, wherein during the process at least one spacing-element (21) is removable inserted between the baseplate (11) and at least one of the plurality of tread elements (13, 13*a*, 13*b*, 13*c*, 13*d*) for creating an undercut (14) for the reception of a section of an edge of an opening in the bottom portion of the shoe upper.
26. Method according to example 25, wherein at first the plurality of tread elements (13, 13*a*, 13*b*, 13*c*, 13*d*) is produced and afterwards, by means of the at least one spacing-element (21), the baseplate (11) is injection molded to the plurality of tread elements (13, 13*a*, 13*b*, 13*c*, 13*d*).

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A method for manufacturing a shoe comprising a baseplate, the method comprising:
forming a substantially planar body of the baseplate;
unitarily forming a plurality of tread elements in one piece with the body, so that the plurality of tread elements extend from a lowermost surface of the body; and
removably inserting the baseplate into a shoe upper to provide stability to the shoe upper;
wherein the shoe upper comprises a bottom portion comprising a plurality of openings and at least one first region and at least one second region;
wherein the at least one first region surrounds at least one of the plurality of openings and the at least one second region defines a bottommost surface of the shoe upper and at least partially surrounds the at least one first region; and
wherein the at least one first region is more elastic than the at least one second region;
inserting the plurality of tread elements to protrude through a respective opening of the plurality of openings; and
engaging each of the plurality of tread elements with an edge of the respective opening of the plurality of openings to fix the plurality of tread elements relative to the shoe upper.

2. The method of claim 1, wherein the baseplate is manufactured in a 3D-printing process or an injection molding process.

3. The method of claim 2, wherein, during the process of unitarily forming the plurality of tread elements in one piece with the body, the plurality of tread elements and the body are injection molded to one another.

4. The method of claim 1, wherein the baseplate is manufactured in an injection molding process and during the injection molding process at least one spacing element is removably inserted between the body and at least one of the plurality of tread elements to create an undercut for receiving at least a section of the edge of the respective opening of the plurality of openings.

5. The method of claim 4, wherein the at least one spacing element comprises a ring disk.

6. The method of claim 1, wherein the baseplate extends from a heel region of the shoe upper to a toe region of the shoe upper.

7. The method of claim 1, wherein each of the plurality of tread elements is configured to correspond to the respective opening of the plurality of openings in the bottom portion of the shoe upper, such that there is configured to be a one-to-one correspondence between the tread elements and the openings.

8. The method of claim 1, wherein the at least one first region comprises a textile material.

9. The method of claim 1, wherein the baseplate comprises a first baseplate, the method further comprising interchanging the first baseplate with a second baseplate, wherein the second baseplate comprises an arrangement or design of tread elements that is different from an arrangement or design of the plurality of tread elements of the first baseplate.

10. The method of claim 1, wherein the baseplate is configured to cover substantially all of the bottom portion of the shoe upper.

11. A method for manufacturing a baseplate for a shoe, the method comprising:

forming a substantially planar body, which provides stability to a shoe upper of the shoe when the baseplate is removably inserted into the shoe upper;

unitarily forming a plurality of tread elements in one piece with the body, so that the plurality of tread elements extend from a lowermost surface of the body;

forming at least one undercut on an outer surface of at least one of the plurality of tread elements that abuts the lowermost surface of the body; and forming at least one groove on the outer surface of the at least one of the plurality of tread elements that intersects the at least one undercut, wherein the at least one groove has a longitudinal direction that extends along a substantially vertical direction of the at least one of the plurality of tread elements, wherein the at least one groove extends a first distance along the longitudinal direction, and wherein the first distance is less than a height of the at least one of the plurality of tread elements.

12. The method according to claim 11, wherein the baseplate is manufactured in a 3D-printing process or an injection molding process.

13. The method according to claim 12, wherein, during the process of unitarily forming the plurality of tread elements in one piece with the body, the plurality of tread elements and the body are injection molded to one another.

14. The method according to claim 11, wherein the baseplate is manufactured in an injection molding process and during the injection molding process at least one spacing element is removably inserted between the body and at least one of the plurality of tread elements to create the at least one undercut.

15. The method according to claim 14, wherein the at least one spacing element comprises a ring disk.

16. The method according to claim 11, wherein the plurality of tread elements protrude through a respective opening of a plurality of openings in a bottom portion of the shoe upper when the baseplate is removably inserted into the shoe upper, wherein the bottom portion comprises at least one first region and at least one second region, wherein the at least one first region surrounds at least one of the plurality of openings and the at least one second region defines a bottommost surface of the shoe upper and at least partially surrounds the at least one first region, and wherein the at least one first region is more elastic than the at least one second region.

17. The method according to claim 11, wherein a first subset of the plurality of tread elements comprises studs with a first height extending from a first adjacent portion of the lowermost surface of the body and a second subset of the plurality of tread elements comprises plugs with a second height extending from a second adjacent portion of the lowermost surface of the body, wherein the first height is greater than the second height.

18. The method according to claim 17, wherein a third subset of the plurality of tread elements comprises studs with a third height extending from a third adjacent portion of the lowermost surface of the body, wherein the third height is (i) less than the first height and (ii) greater than the second height.

19. The method according to claim 17, wherein the studs protrude through a respective opening of a plurality of openings in a bottom portion of the shoe upper when the baseplate is removably inserted into the shoe upper and are configured to close the respective opening of the plurality of openings in the bottom portion of the shoe upper when the baseplate is inserted in the shoe upper.

* * * * *